US005644099A

United States Patent [19]

Rabbow et al.

[11] Patent Number: 5,644,099

[45] Date of Patent: Jul. 1, 1997

[54] PROXIMITY DETONATOR

[75] Inventors: Jürgen Rabbow; Georg Schmucker, both of Ulm, Germany

[73] Assignee: Telefunken Systemtechnik GmbH, Ulm, Germany

[21] Appl. No.: 760,506

[22] Filed: Jan. 18, 1977

[51] Int. Cl.[6] ..... F42C 13/04

[52] U.S. Cl. ..... 102/214; 102/213; 342/166

[58] Field of Search ..... 102/70.2 P, 211–214; 343/7 PF, 8, 9; 342/68, 166

[56] References Cited

U.S. PATENT DOCUMENTS

| | | | |
|---|---|---|---|
| 3,408,938 | 11/1968 | Pagazani et al. | 102/70.2 P |
| 3,772,696 | 11/1973 | Kummer | 343/9 |
| 3,850,103 | 11/1974 | Krupen | 102/70.2 P |
| 4,098,191 | 7/1978 | Bagwell et al. | 102/213 |
| 4,159,476 | 6/1979 | Kohler | 342/68 |
| 4,168,663 | 9/1979 | Kohler | 102/214 |
| 4,185,560 | 1/1980 | Levine | 102/214 |
| 4,232,609 | 11/1980 | Held | 102/214 |

*Primary Examiner*—Michael J. Carone
*Assistant Examiner*—Christopher K. Montgomery
*Attorney, Agent, or Firm*—Spencer & Frank

[57] ABSTRACT

A proximity fuse, hereinafter called detonator for flying bodies, particularly missiles, to combat flying targets using speed information regarding the speed between detonator and target, wherein the firing of the detonator is initiated when the speed of approach $v_a$ and the relative speed $v_r$ differ by a firing value $K_z$ which is selected in dependence on the optimum point of firing where $$v_a = -\frac{\partial}{\partial t}\,|\bar{r}| \tag{1}$$

$$v_r = \left|\frac{\partial}{\partial t}\,\underline{r}\right| \tag{2}$$

and $\hat{\bar{r}}$=the location vector from detonator to target;

$$\frac{\partial}{\partial t}$$

=the differential quotient after time t.

13 Claims, 5 Drawing Sheets

PROXIMITY DETONATOR

BACKGROUND OF THE INVENTION

The present invention relates to a proximity detonator for flying objects, particularly missiles, for combating flying targets with the use of information regarding the speed between detonator and flying target.

It is known that detonators in flying bodies used to combat flying targets generally employ two sensors, a contact switch which is to respond if a direct hit has been made, and a proximity detonator which is to initiate the self-destruct mechanism of the charge if no direct hit is possible. In other words, such proximity detonator must be designed so that it will not self-destruct if a direct hit is possible and that in the other case it determines the moment of self-destruction so that as many fragments as possible will hit the target.

In a known proximity detonator, self-destruction is initiated in dependence on an angular measurement, as soon as the angle between the line of sight between detonator and target and the longitudinal axis of the flying body carrying the charge and the detonator has reached or exceeded a certain value. In order to prevent self-destruction if a direct hit should be possible later, the proximity measuring portion of this known proximity detonator must be nonsensitive in the direction of the longitudinal axis of the flying body. This can be accomplished in principle with the use of a radar process by providing a zero position in the antenna diagram of the proximity measuring portion of the detonator. The drawback of this is that, particularly when this known detonator is intended for small flying bodies, e.g. for missiles, there is no known way of taking such angle measurement with sufficient accuracy. In the likewise known use of the radar process the zero position in the antenna diagram can also be realized only incompletely so that it may happen that the missile self-destructs in spite of a later possible direct hit.

A further known proximity detonator utilizes a distance measurement with the aid of very short radar pulses. The drawback of this is that there is no known possibility of making the moment of self-destruction dependent, in the desired manner, on the speed relationships between the detonator and the target. Here, too, a zero position must be given in the antenna diagram which again can be realized only incompletely, particularly with small flying bodies such as missiles so that self-destruction before a later direct hit is not impossible.

A process is finally known, particularly for radar detonators for missiles, which operates with the use of information regarding the relative speed between the detonator and the target and can get along without a zero position in the antenna diagram. It is also known that in the radar art a frequency shift occurs as a result of the Doppler effect, when one or two objects move, corresponding to the speed of the objects with respect to one another, which Doppler effect can be utilized to obtain the above-mentioned information. At the moment at which the detonator and the target have reached a minimum distance in this case, this frequency shift becomes zero. Precisely this criterion is utilized in the known process to actuate self-destruction of the combat charge. The drawback of this process is that the detonation occurs too late, due to the travel time required, for fragments of the missile to reach the target, particularly if the speed between the detonator and the target approaches the order of magnitude of the speed of the fragments.

Regarding the above-mentioned state of the art, reference is made to "Impulsfreie elektrische Rückstrahlverfahren" (Pulse-free electrical reflected beam processes) by F. v. Rautenfeld, 1957, Garmisch-Partenkirchen, published by Deutsche Radar-Verlagsgesellschaft m.b.H., particularly pages 92, 142, 148 and 156.

SUMMARY OF THE INVENTION

It is the object of the present invention to provide a proximity detonator of the above-described type which permits determination of the moment of detonation even when used in missiles so that as many fragments as possible will hit the target with adaptation to the encounter situation and under consideration of the speed of the fragments but that, on the other hand, detonation is not initiated if a direct hit would be possible later, without the proximity measuring portion of the detonator having to have a zero position in the direction of the longitudinal axis of the missile.

This is accomplished according to the present invention in that detonation is initiated if the speed of approach $v_a$ and the amount of the relative speed $v_r$ differ by a firing value $K_z$ which is determined according to what is the optimum time for detonation; where $$v_a = -\frac{\partial}{\partial t}\,|\bar{r}| \tag{1}$$

$$v_r = \left|\frac{\partial}{\partial t}\,\bar{r}\right| \tag{2}$$

and $\bar{r}$=the location vector from detonator to target;

$\frac{\partial}{\partial t}$

=the differential quotient after time t.

DETAILED DESCRIPTION OF THE PREFERRED EMBODIMENT

Figure 1:
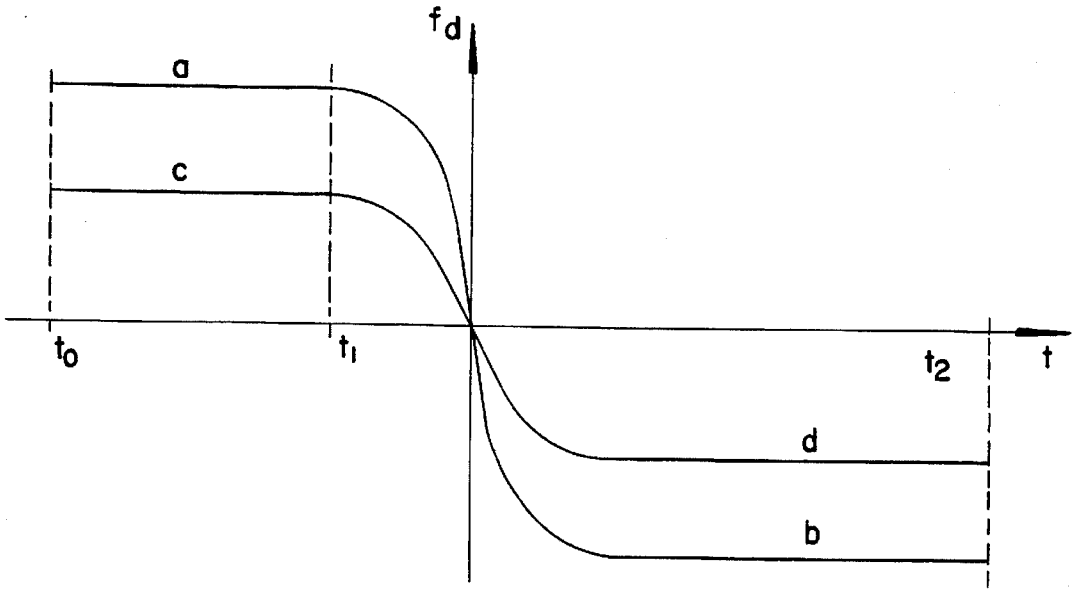
FIGS. 1 and 2 are graphs of Doppler frequency vs. time used in explaining the operation of a detonator according to the invention.

The operation and advantages of the detonator according to the invention will be described below for an embodiment of a special self-contained active radar detonator. It is to be understood, however, that the present invention is conceivable also for other uses, for example with utilization of the laser art or with acoustic processes.

A self-contained active radar detonator does not receive any information in addition to that which it obtains itself. However, it does contain its own transmitter which continuously radiates signals at a certain frequency $f_s$.

The energy reflected by the target is received by the transmitter at a frequency $f_e$ and the following applies $$f_e = f_s\,(1+2\,v/c \tag{3}$$

where c=speed of light.

The following also applies $$v=-\frac{\partial}{\partial t}|\vec{r}| \tag{4}$$

A comparison between $f_s$ and $f_e$ provides the Doppler frequency $f_d$ $$f_d=\frac{2v}{c}\cdot f_s \tag{5}$$

Since the transmitting frequency $f_s$ and the speed of light c are known, the Doppler frequency $f_d$ provides an information about the speed v. A comparison between equations (4) and (1) shows that the speed v is equal to the approach speed $v_a$.

For the case where the minimum distance $r_{min}$ between detonator and target is finite, the following generally applies:

$$v_r=|\vec{r}|\lim_{\to\infty}(v_a) \tag{6}$$

Equation (6) can also be expressed differently: that is, for $$|\vec{r}|\gg r_{min} \tag{7}$$

the following applies $$v_r\sim v_a \tag{8}$$

If now the detonator has a range for its radial component which is sufficiently large compared to the expected or permitted minimum distance $r_{min}$, it will initially measure the relative speed via the Doppler frequency. Upon approaching the target, the Doppler frequency decreases and becomes zero once target and missile have reached their mutual minimum distance. A comparison of the continuously measured speed of approach $v_a$ with the initially measured relative speed $v_r$ (equations 6 to 8) now permits detonation to be initiated if the difference between both has reached the value $K_z$ which above and hereinafter has been and will be called the firing value.

It can be demonstrated very easily how the firing value $K_z$ must be varied in dependence on the encounter situation if such variation is necessary at all. It generally applies that if an exact hit of the fragments on that point of the target to which the detonator responds is required, the following condition must be met for the firing value:

$$K_z=v_r\left(1-\frac{K_g+v_r/v_s}{\sqrt{1+(v_r/v_s)^2+2(v_r/v_s)\cdot K_g}}\right) \tag{9}$$

where $v_s$=the speed of the fragments with respect to the missile;

$K_g$=the characteristic geometric value.

The characteristic geometric value $K_g$ contains no speeds. It can be represented, for example, as a function of the angle enclosed between the direction of the fragments and the longitudinal axis of the missile, the lead angle occurring between the missile speed vector and the relative speed vector, as well as the passing flight angle which describes the position of the speed triangle formed of the vectors of the target speed, the missile speed and the relative speed with respect to the vector of the minimum distance. If these angles are known to the detonator, it will be possible to precisely determine the firing value $K_z$.

However, this is not absolutely necessary in order to realize satisfactory operation of the detonator according to the invention. For a self-contained detonator for missiles it can be assumed, for example, that information other than the relative speed $v_r$ is not available. However, in such case the lead angles are generally small and equation (9) can be simplified as follows:

$$K_z\approx v_r\left(1-\frac{v_r/v_s}{\sqrt{1+(v_r/v_s)^2}}\right) \tag{10}$$

Consideration of the function of equation (10) shows that in the case where $$0.4\leqq\frac{v_r}{v_s}\leqq 2 \tag{11}$$

further simplification is possible inasmuch as the firing value $K_z$ can be set constant with slight errors. The firing value $K_z$ will then advantageously be between 25 and 30% of the fragment speed with the exact value depending on the range being utilized in equation (11). If a larger range than that of equation (11) is to be utilized, equation (10) can of course be simulated very easily, for example by means of a diode network.

It should also be mentioned that the fragment speed is not constant in time but decreases with the time the fragments are in flight. It is easiest to use that fragment speed which occurs as the average fragment speed until the maximum effective radius has been reached; a more precise determination which can be done mathematically under consideration of all occurring distributions will furnish a better approximation.

Finally it must be pointed out that it is of course also possible to provide information for the detonator from external sources. For example, in missile systems employing control by homing devices the relative speed is often known, thus the detonator need not measure it itself. Similar conditions may apply for the angles from the geometric constant.

The present invention generally affords the possibility of effecting a determination of the moment of firing depending on the information at hand, good accuracy being possible also with great variations of the relative speed $v_r$. Special measures to prevent self-destruction of the combat charge before a later prossible direct hit need not be taken for the detonator according to the present invention since with a direct hit the speed of approach $v_a$ until contact is equal to the relative speed $v_r$, i.e. the firing condition is not met; this fact will be explained in detail in connection with FIGS. 1 and 2.

FIG. 1 shows the time dependence of the Doppler frequency $f_d$ in a radar detonator upon approach to its respective target. At time $t_0$ a Doppler frequency emerges from the receiver noise which, with a large distance to the target, is approximately constant and then decreases relatively shortly before the point of reverse. The point of reverse is understood to mean, in the usual manner, that point at which the relative radial speed between detonator and target is zero. After reaching the point of reverse the distance between detonator and target increases again, the Doppler frequency increases again in a mirror image to the frequency axis, i.e. to the ordinate of the diagram of FIG. 1 but in the opposite phase.

In FIG. 1, a indicates that part of a curve $f_d$=f(t) which corresponds to the time, during the approach of the detonator to its target, between the appearance of the Doppler frequency, from out of the noise, and the reaching of the point of reverse, at which time curve portion a decreases to the time axis, i.e. the abscissa. That curve portion of the same function which corresponds to the time between reaching the point of reverse and the disappearance of the Doppler frequency in the noise at time $t_2$ is marked b. The corresponding curve portions of a function associated to a lower relative speed $v_r$ between detonator and target than the function of curve portions a and b are marked c and d. At this opportunity it should be pointed out that the frequency drop of the Doppler frequency $f_d$ toward zero begins approximately at the same time $t_1$ for both curve portions a and b but with different slopes. In the same sense the mirror-image curve portions d and b also have different slopes.

Figure 2:
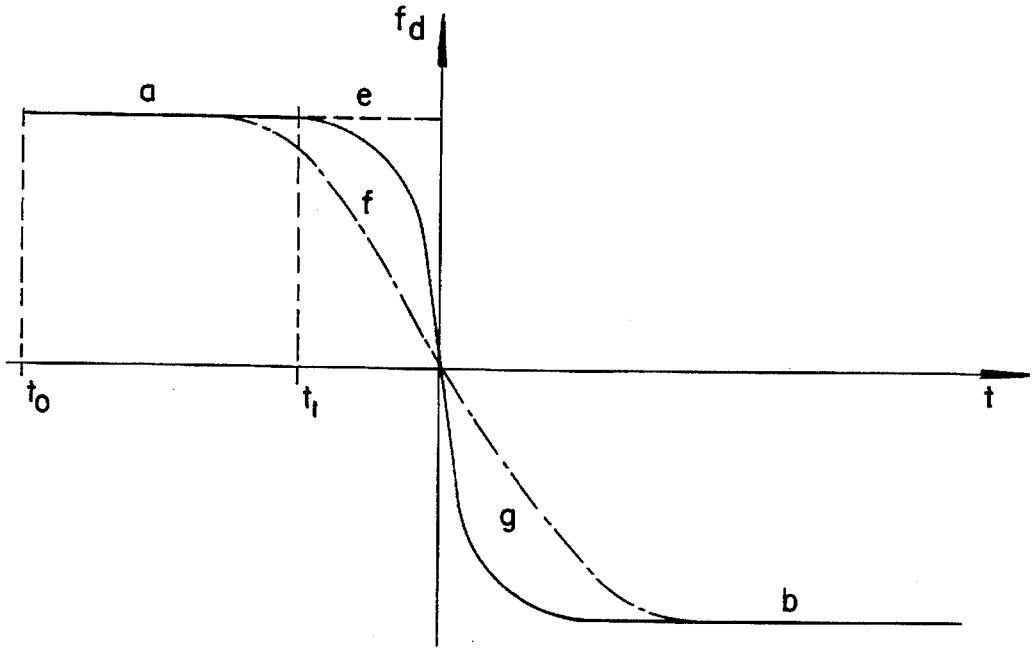

FIG. 2 once again shows the function with curve portions a and b in solid lines. For the case, that the detonator will not fly by the target but hit the target, the Doppler frequency $f_d$ remains constant over the further time periods equal to that between time intervals $t_0$ and $t_1$. This case is shown in FIG. 2 in dashed lines and marked as function part e whereas at t=0 impact occurs. Additionally there is in FIG. 2 a dot-dash function part f with its mirror-image extension g to show the differences which result compared to the function having curve portions a and b when the detonator flies by the target at a greater distance.

Figure 3:
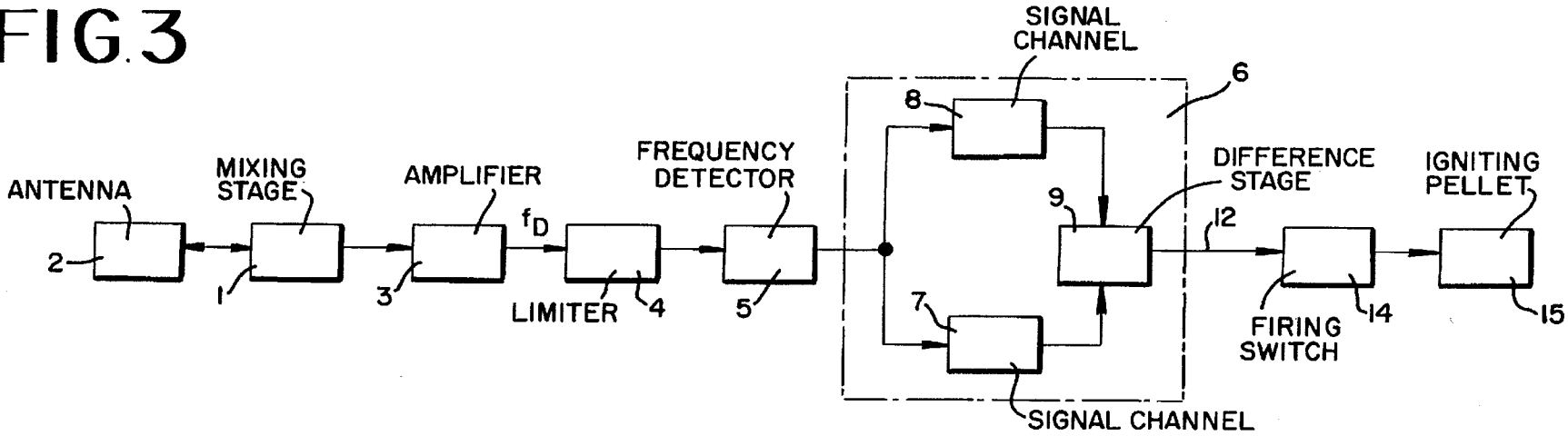
FIGS. 3 through 8*a* show circuits explaining several embodiments of the invention.

FIG. 3 shows the block diagram of a preferred embodiment of the invention wherein the firing value $K_z$ may be constant or variable according to a predetermined law as otherwise specified.

An antenna 2 is coupled with a mixing stage 1. Via antenna 2 electromagnetic waves are transmitted and echo signals from targets received. The mixing stage 1 delivers to an audio frequency amplifier 3 a doppler frequency signal, the frequency of which is the difference between the transmitting and receiving frequencies. The Doppler frequency signal at the output of the amplifier 3 is designated $f_D$. This Doppler frequency signal is passed through a limiting stage 4. A frequency measuring stage 5 known per se determines the actual value of the Doppler frequency $f_D$ and delivers at its output a direct current voltage the value of which is dependent upon the Doppler frequency.

At the output of the frequency measuring stage 5 is provided a circuit consisting of three stages 7, 8 and 9. This circuit is shown in FIG. 3 within a dash-dotted block 6 which, in more detail, is shown in FIG. 4.

Block 6 comprises two signal channels 7 and 8 whose outputs are connected with the inputs of difference stage 9. In order to decouple both the signal channels 7 and 8 from each other amplifiers 7*a* and 8*a* may be provided; sometimes only one of these amplifiers 7*a* and 8*a* is necessary. In one of the signal channels 7 and 8*a* storage means is provided, for instance in the channel 7*a* storage capacitor 7*b* is included. The storage means stores the value of the direct current voltage which is present at the output of stage 5 when the speed of approach $v_a$ is being initially measured and when the approaching target is still within a sufficiently large distance from the proximity detonator.

Figure 4:
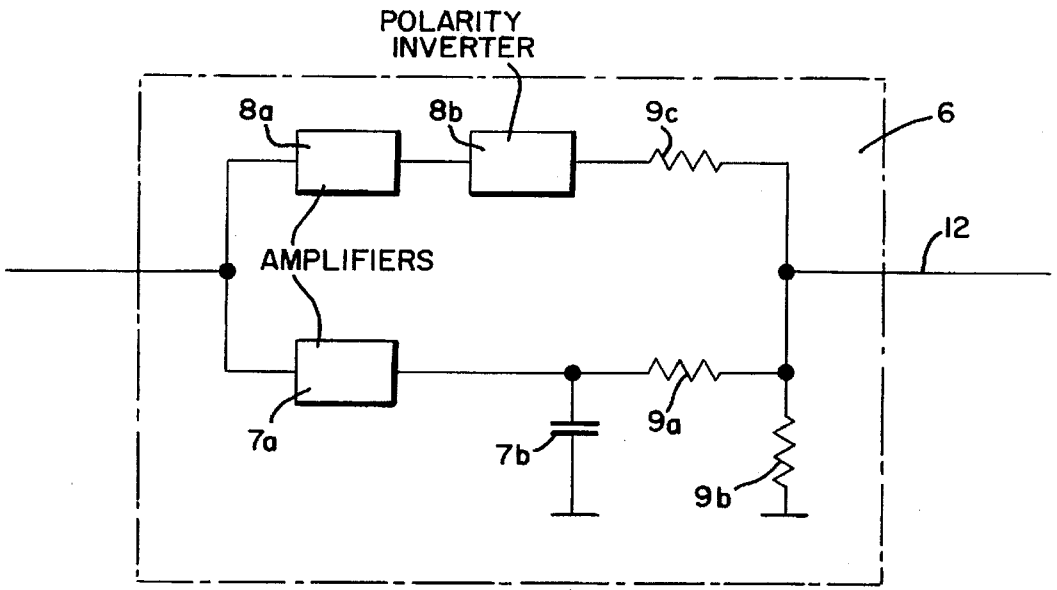

The resistors in FIG. 4 which are designated 9*a*, 9*b* and 9*c*, respectively, are provided in such a way as to realize the difference stage 9. The values of these resistors are preferably chosen equal to each other. Additionally a polarity converting stage is included in one of the signal channels 7 and 8, for instance a polarity converting stage 8*b* within the signal channel 8.

As soon as the difference between the electric potentials at the two inputs of the difference stage 9 reaches a predetermined value, the output signal of stage 9 enables a firing switch 14 to activate an igniting pellet 15 which initiates the detonation.

Figure 5:
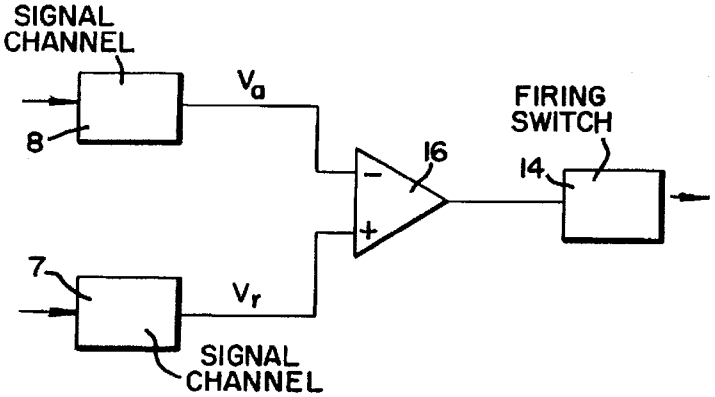

FIG. 5 shows another embodiment of the invention. This embodiment differs from that according to FIGS. 3 and 4 only in the substitution of an operation amplifier 16 for the difference stage 9. The operation amplifier 16 operates as a difference stage and subtracts the potential corresponding to $v_a$ from the potential corresponding to $v_r$. In FIG. 5 it is assumed that firing value $K_z$ is a constant.

Figure 6:
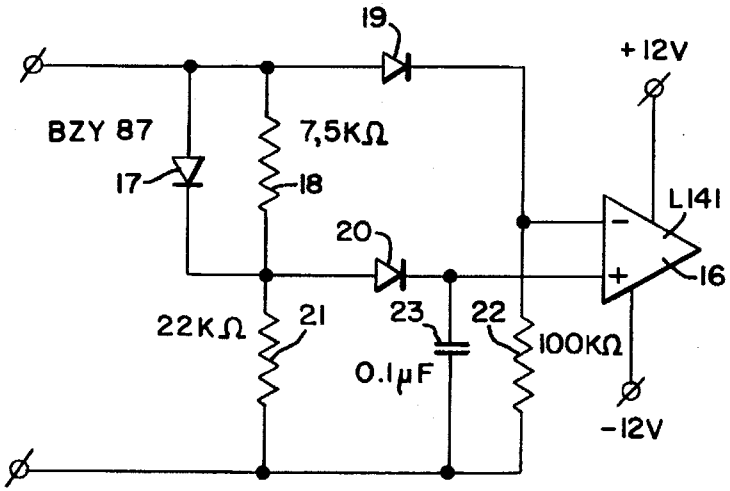

The input circuit of the operation amplifier 16 according to FIG. 6 may be used whenever the firing value $K_z$ will vary in dependence upon $v_r$ and $v_s$, for instance according to the equation $$K_z = v_r\left(1 - \frac{v_r/v_s}{\sqrt{1+(v_r/v_s)^2}}\right). \tag{10}$$

Figure 7:
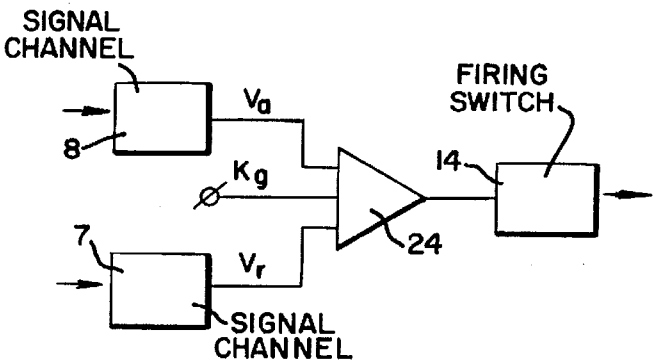

The input circuit according to FIG. 6 comprises a diode 17 shunted by a resistor 18, two diodes 19 and 20 a resistor 21, a further resistor 22 and a capacitor 23. The electrical dimensions of the circuit elements which are indicated in FIG. 6 are typical but not limiting and they may be modified in order to vary the firing value $K_z$ according to another predetermined law. A more advantageous embodiment of the invention is characterized in that the means for varying the firing value $K_z$ considers the angles of encounter by means of the characteristic geometric value $K_g$. For this reason, the embodiment of the invention shown in FIG. 7 comprises an operation amplifier 24 having an additional input which is to be connected with the source (not shown) of the potential corresponding to the geometric value $K_g$. The information necessary for producing a potential according to $K_g$ may be derived from signals in the target seeker of the flying body. The value $K_g$ and the speed values $v_r$ and $v_s$ may be considered by the means for varying the firing value $K_z$ according to the equation $$K_z = v_r\left(1 - \frac{K_g + v_r/v_s}{\sqrt{1+(v_r/v_s)^2 + 2(v_r/v_s)\cdot K_g}}\right). \tag{9}$$

Figure 8:
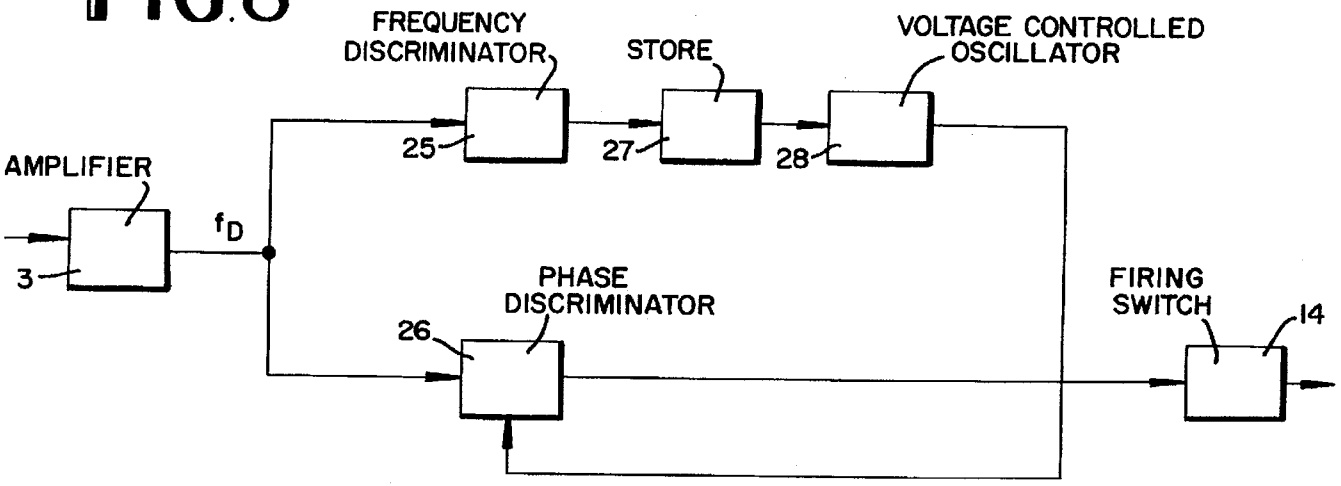

FIG. 8 shows another embodiment of the invention wherein the stages 1 through 3 and 14 through 15 are identical to those described in connection with FIG. 3. The output signal of the audio frequency amplifier 3 is the Doppler frequency $f_D$ and is fed to two discriminators 25 and 26. At the output of the frequency discriminator 25 a direct current voltage appears which is proportional to the value $v_r$. This value is stored by means of storage device 27, the output of which is connected with the control input of a voltage controlled oscillator (VCO) 28. The frequency $f_{VCO}$ of the VCO 28 is used as a reference frequency within the phase discriminator 26 whose output signal actuates the firing switch 14 as soon as $f_D \leq f_{VCO}$. The embodiment according to FIG. 8 initiates the firing of the detonator when the speed of approach $v_a$ and the relative speed $v_r$ differ by a constant predetermined firing value $K_z$.

Figure 8A:
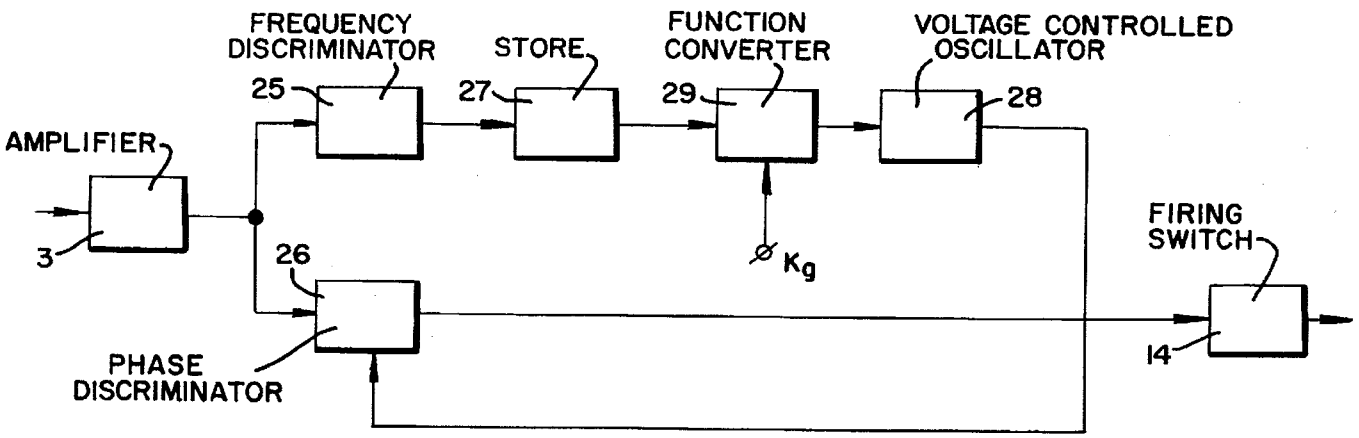

FIG. 8*a* shows another embodiment of the invention which differs from that according to FIG. 8 by the insertion of a function converter means 29 between the VCO 28 and the storage device 27. That converter means 29 considers the dependence of the firing value $K_z$ upon the speed value $v_r$.

Furthermore the geometric value $K_g$ may be fed into the converter means 29.

Figure 9:
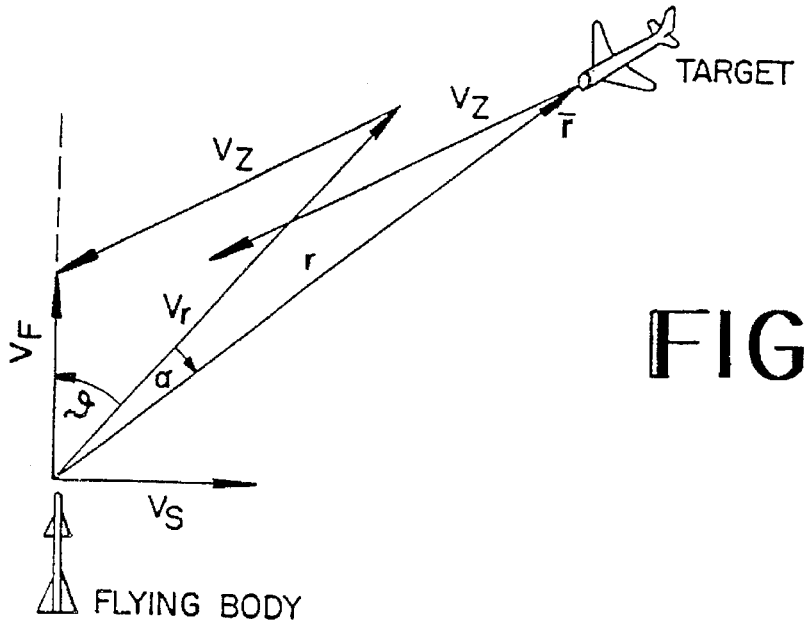
FIG. 9 is a graph explaining the geometric relationships between a flying body and its target.

FIG. 9 illustrates the encounter between a flying body and its target showing the geometric relationships of the two bodies and including the speed vectors, the value $v_r$ being the difference between the speed vector $v_F$ of the flying body and the speed vector $v_Z$ of the target.

Figure 10:
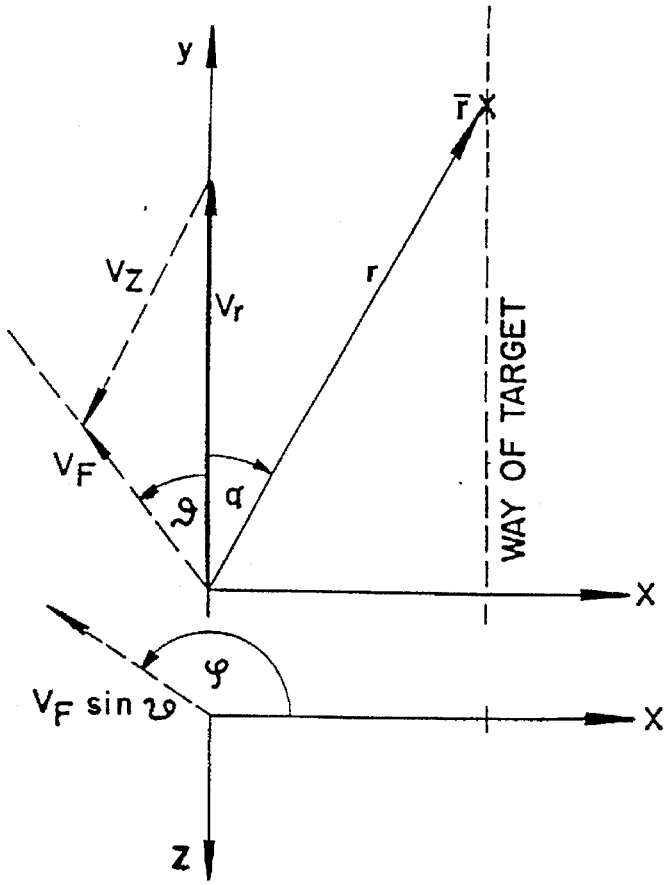
FIG. 10 displays the coordinate system used and the according geometric relations.

When considering the dynamic variations of the geometric relationships between the flying body and its target a coordinate system advantageously may be used the origin of which is based on the flying body, the ordinate of which coincides with the speed vector $v_r$ and the abscissa of which is oriented so that the target is moving in the x-y-plane (FIG. 10). The z-axis is added to form a right hand coordinate system.

The following definition apply:

$\delta$=the angle between $v_F$ and $v_r$ (lead angle)

$\alpha$=the angle between $v_r$ and the line of sight between the target and the flying body $\phi$=the angle between the x-axis and the component of $v_F$ in the x-z-plane (the passing flight angle)

r=the distance between target and flying body

Equation (9) has been derived on the condition that detonation should occur when the fragments will hit the target. This condition is equal to the condition that the relative velocity of the fragments is parallel to the line of sight. The relative velocity of the fragments is easily computed by vector addition of $v_r$ and $v_s$ with $v_s$ in most cases being perpendicular to the longitudinal axis of the flying body. Using the aforementioned conditions a short computation yields:

$$K_g = \frac{\mathrm{tg}\delta\cos\phi}{\sqrt{1+\mathrm{tg}\delta\cdot\cos\phi)^2}} \tag{11}$$

The geometric value $K_g$ can as an example be generated by microcomputers contained in modern seeker heads. It should be noted that the lead angle is frequently used in seeker heads to adjust the guidance law and that the passing flight angle is delivered by measuring the latest movement of the antenna of the seeker head.

Other possibilities also exist to measure the lead angle and the passing flight angle and to perform the computation of equation (11).

It will be understood that the above description of the present invention is susceptible to various modifications, changes and adaptations and the same are intended to be comprehended within the meaning and range of equivalents of the appended claims.

What is claimed is:

1. In a proximity detonator for flying bodies for combating flying targets, including a system for providing speed information regarding the relative speed between detonator and target, the improvement comprising means for providing signals corresponding to the speed of approach $v_a$ and the relative speed $v_r$ between the detonator and the target; and means for comparing said signals and for initiating the firing of the detonator when the speed of approach $v_a$ and the relative speed $v_r$ differ by a firing value $K_z$ which is selected in dependence on the optimum point of firing, where $$v_a = -\frac{\partial}{\partial t}\,|\bar{n}|$$

$$v_r = \left|\frac{\partial}{\partial t}\,\bar{n}\right|$$

and $\hat{\bar{r}}$=the location vector from detonator to target;

$$\frac{\partial}{\partial t}$$

=the differential quotient after time t.

2. A proximity detonator as defined in claim 1 wherein with sufficiently large distances, said means for comparing compares signals corresponding to the continuously measured speed of approach $v_a$ with a signal corresponding to the initially measured speed of approach $v_a$, which is approximately equal to the relative speed $v_r$.

3. A proximity detonator as defined in claim 1 wherein said firing value $K_z$ is a constant.

4. A proximity detonator as defined in claim 3 wherein said firing value $K_z$ is between 25% and 30% of the average speed of the fragments produced after detonation, with said average speed of fragments taking into consideration the different starting speeds of the fragments and the decrease in the fragment speed until the maximum effective radius of the combat charge has been reached.

5. A proximity detonator as defined in claim 1 wherein said means for comparing and initiating the firing includes means for varying the firing value $K_z$ under consideration of the relative speed $v_r$ and of the speed $v_s$ of the fragments after detonation.

6. A proximity detonator as defined in claim 5 wherein said means for varying said firing value $K_z$ varies same only under consideration of the relative speed $v_r$ and the fragment speed $v_s$.

7. A proximity detonator as defined in claim 6 wherein said means for varying said firing value $K_z$ varies same according to the equation $$K_z = v_r\left(1-\frac{v_r/v_s}{\sqrt{1+(v_r/v_s)^2}}\right).$$

8. A proximity detonator as defined in claim 5 wherein said means for varying said firing value $K_z$ varies same under consideration of encounter including at least one of the lead angle as the angle between the vectors of relative speed and the speed of the missile or flying body, the passing flight angle as the angle between the vector of the minimum distance and the plane defined by the vectors of relative speed and the speed of the missile or flying body, as well as the fragment angle known for the missile as the angle of the direction of flight of the fragments with respect to the longitudinal axis of the missile.

9. A proximity detonator as defined in claim 8 wherein said means for varying the firing value $K_z$ considers the angles of encounter by means of a characteristic geometric value $K_g$ and varies said firing value $K_z$ according to the equation $$K_z = v_r\left(1-\frac{K_g+v_r/v_s}{\sqrt{1+(v_r/v_s)^2+2(v_r/v_s)\cdot K_g}}\right).$$

10. A proximity detonator as defined in claim 8 wherein, if the lead angle is determined, the longitudinal axis of the flying body is used as a reference and not the direction of the speed vector of the flying body.

11. A proximity detonator as defined in claim 1 wherein said detonator is a self-contained detonator which measures the respectively required parameters itself.

12. A proximity detonator as defined in claim 1 wherein part of the respectively required parameters are fed to the detonator from an external source.

13. A proximity detonator as defined in claim 1 wherein the flying body is a missile.

* * * * *